United States Patent [19]

Loeffler et al.

[11] 3,981,708

[45] Sept. 21, 1976

[54] SYSTEM FOR PRODUCING BLANKETS AND WEBS OF MINERAL FIBERS

[75] Inventors: Romain Eugene Loeffler, Littleton; Forrest Theodore Rollins, Englewood, both of Colo.

[73] Assignee: Johns-Manville Corporation, Denver, Colo.

[22] Filed: Jan. 15, 1975

[21] Appl. No.: 541,358

[52] U.S. Cl. ..... 65/4 R; 65/9; 156/62.8; 264/112; 425/81; 425/83

[51] Int. Cl.[2] ..... C03B 37/00

[58] Field of Search ..... 65/4 R, 9, 11 R; 156/62 B; 264/112, 113; 425/81, 83

[56] References Cited

UNITED STATES PATENTS

| | | | |
|---|---|---|---|
| 2,692,220 | 10/1951 | Labino | 65/9 X |
| 2,830,648 | 4/1958 | Haddox | 65/4 R |
| 3,429,681 | 2/1969 | Krakauer et al. | 65/9 |
| 3,824,086 | 7/1974 | Perry et al. | 65/9 |

*Primary Examiner*—Robert L. Lindsay, Jr.
*Attorney, Agent, or Firm*—Robert M. Krone; Joseph J. Kelly; John H. Miller

[57] ABSTRACT

A recent development for manufacturing blankets of mineral fibers includes a system comprising a plurality of fiber forming and collecting modules spaced along a process line, each module designed to produce a relatively thin web of intertangled fibers and to deliver the thin web onto a common transfer conveyer to produce a plurality of superposed webs which can later be further processed to form a thick, uniform, mineral fiber blanket. The present invention provides an improvement in the above described system by permitting one or more of the modules to be operated independently of the remaining modules resulting in the manufacture of one or more secondary products when the primary product being made on the main transfer conveyer requires the operation of less than all the modules in the process line. The improved system includes means for removing a web from the collecting conveyer of a module prior to its being delivered to the transfer conveyer, means for elevating the web to the fiberizing level of the system, means for cutting the web into desired lengths, and means for accumulating the cut lengths into a form suitable for packaging, storage, and shipment. The improved system can optionally also include searing rolls to at least partially cure the binder in the web prior to elevating the web to the fiberizing level, slitting knives for edged trimming and slitting the web into desired widths, and other conventional web treating and laminating equipment.

20 Claims, 7 Drawing Figures

35
34
39
36a
41a
13a
42a
14a
40a
43a
44a
19a
130a
126a
125a
124a
122a
118a
119a
120a
116a
128a
41
11a
45a
88
63
48a
49a
52a
57a
58a
51a
55a
56a
15a
25
12a
29a
28a
75
74
32
68a
66a
78a
76a
31a
26a
81a
73a
61a
16a
102a
106a
108a
110a
114a
112a
17a
13a
100a
104a
59a
33a
27a
12b
53b
115a
45b
48b
49b
11b
19b
130b
126b
125b
124b
122b
118b
119b
120b
116b
110b
108b
106b
102b
16b
59b
17b
13b
33b
12b
114b
115b
104b
100b

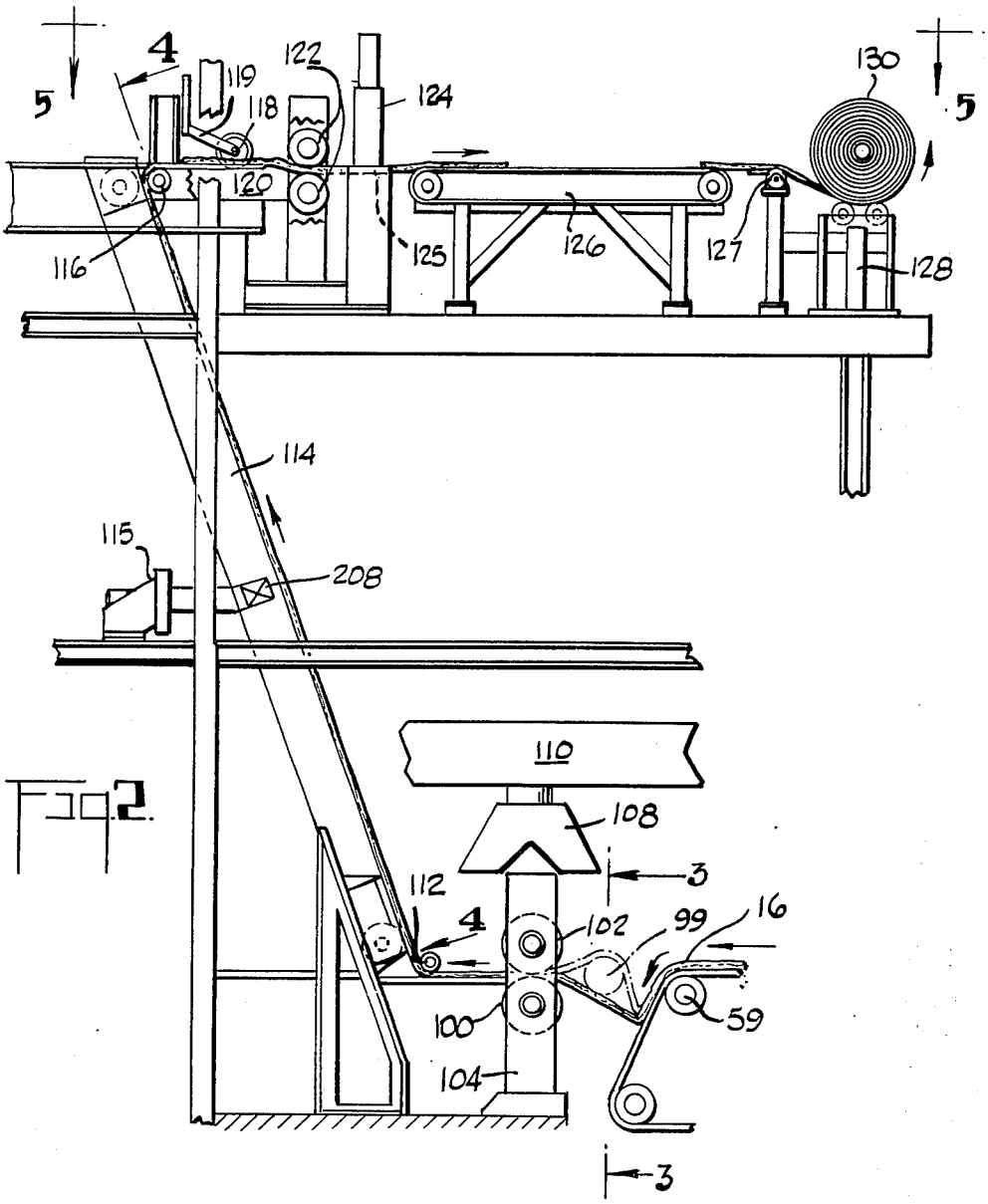
Fig. 2.
Fig. 3.
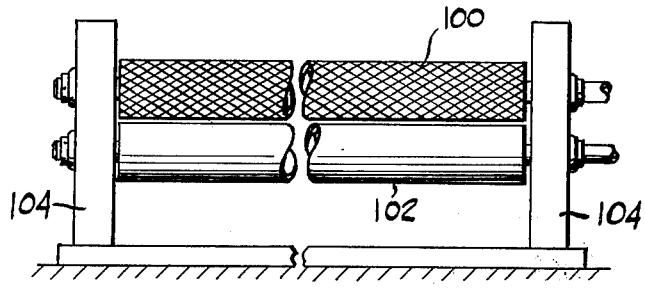

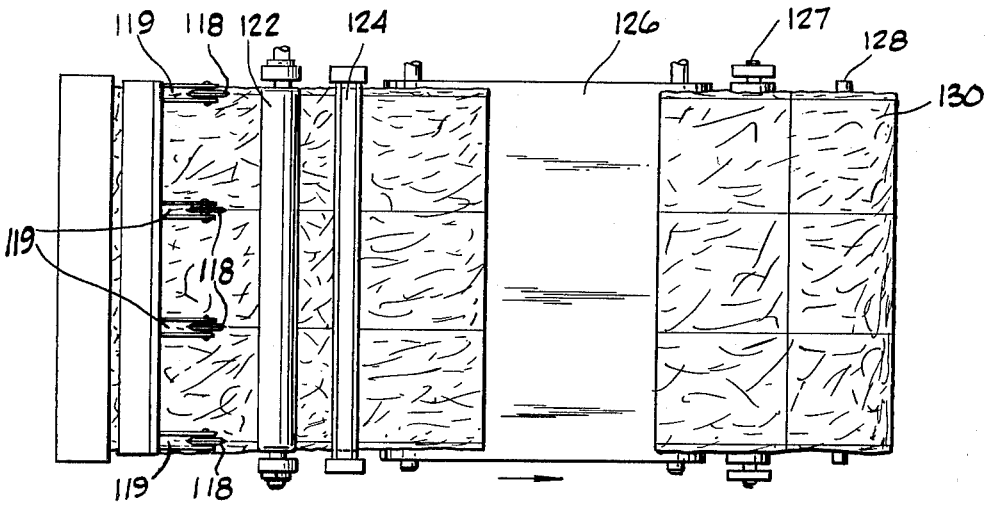
Fig. 5.
Fig. 6.
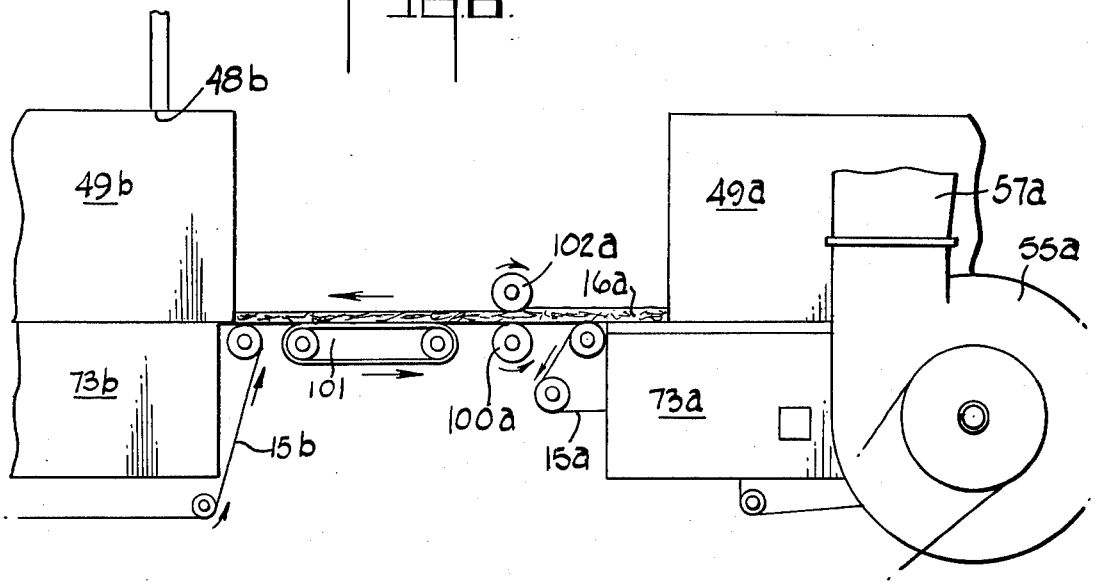

SYSTEM FOR PRODUCING BLANKETS AND WEBS OF MINERAL FIBERS

BACKGROUND OF THE INVENTION

Recent developments in the manufacture of thick blankets of intertangled mineral fibers include systems comprising a plurality, e.g. 4 to 6 or more, fiber forming and web forming modules, each producing a relatively thin, permeable, lightweight, web of intertangled mineral fibers. The webs from each of these modules are sequentially delivered to a transfer conveyor running under the modules to form a thick layer of superposed webs, which layer can later be processed into relatively thick mineral fiber blankets having a high degree of uniformity through the thickness of the blanket. These modular processes represented a significant improvement in the prior art technique of forming relatively thick mineral fiber blankets, particularly in the uniformity of the resultant product. Typical systems of the type described above are described in more detail in U.S. Pat. application Ser. No. 236,372 filed Mar. 20, 1972 and in U.S. Pat. No. 3,824,086, the disclosures of which are herein incorporated by reference.

Although the above described systems represent a significant improvement in the manufacture of thick fiber glass blankets, there are features in these systems that need further improvement to permit the systems to be used more effectively. The initial capital expenditure required to build a system of the type described above, containing five or six modules, amounts to several millions of dollars. Once built, each module, in a pot and marble operation, requires an operator to insure that the fiberizing portion of the module is always operating properly. Although many products desired to be manufactured on these systems require that all of the modules operate simultaneously, many of the products are of a thickness that require the operation of less than all of the modules. When such products are being manufactured by the system described above, one or more modules remain idle, and the operators of these modules either remain idle or must be transferred temporarily to other duties, which is not always possible. Because of the large capital investment requirement of these systems, and operating costs that continue regardless of whether each module is operating or idle, the economics would be improved considerably if all of the modules could be operated continuously regardless of the requirements of the primary product being manufactured by the system.

One solution to this problem is discussed in Ser. No. 236,372 and amounts to dividing the transfer conveyer into two sections with the direction of travel of each sectional transfer conveyer being reversible. Then, if only a portion of the modules are required in the manufacture of the primary product, this portion of the modules can be selected from the modules at one end of the process, leaving the remaining modules on the opposite end of the system to manufacture a secondary product. The transfer conveyer under the modules not required for the primary product is reversed, these modules deliver their individual mats to the reversed transfer conveyer which delivers a secondary product of one, or two or more superposed layers, to the end of the system opposite the end to which the primary product is being delivered. While this modification can be used to solve the above described problem it adds to the building space requirements of the over-all system because it requires that additional processing equipment be located adjacent, and extending from, each end of the system. Also, additional personnel are required to operate the equipment at each end of the system simultaneously and this additional personnel becomes surplus when the primary product requires operation of all of the modules. Thus, this solution to the problem, while operable, is not entirely satisfactory from an economical standpoint.

It is an object of the present invention to modify the systems described above in such a manner that all or some of the modules can be operated independently of the overall system to manufacture separate and useful products when simultaneous operation of all of the modules are not required in the manufacture of the primary product.

It is a further object of the present invention to modify the systems described above to accomplish the above described objective using a minimum amount of additional equipment located in available space, i.e. without requiring additional building space requirements.

It is a further objective of the present invention to accomplish the described objectives and further to manufacture additional useful products without requiring additional operating personnel.

It is a further objective of the present invention to accomplish the above described objectives and also to provide the above described systems with increased production capacity and versatility.

BRIEF SUMMARY OF THE INVENTION

Accordingly, the present invention provides an improvement in a system for the production of mineral fiber mats comprising a plurality of mat forming modules arranged in an in-line orientation, each module having a fiberizing means, a mat forming chamber, a mat delivery station, a foraminous fiber collecting conveyer in said mat forming chamber to collect fiber in mat form and to deliver the mat to the delivery station, and a suction box in communication with the forming chamber through the fiber collecting conveyer; the mat delivery stations of respective modules being spaced apart in said in-line orientation; and a transfer conveyer means arranged to travel adjacent the plurality of said spaced delivery stations and parallel to said in-line orientation, said transfer conveyer means adapted to receive mats sequentially from the individual delivery stations at spaced locations along said conveyer means; each of said delivery stations including means for superposing the mat on the transfer conveyer surface or on the mat delivered from at least one preceding delivery station, the improvement comprising means located adjacent the downstream end of said collecting conveyer for removing said mat from said collecting conveyer, means for elevating said mat to the vicinity of the fiberizing level, means for cutting said mat into desired lengths, and means for accumulating said cut lengths. The present invention also provides an improvement in a method for the production of mineral fiber products by means of a plurality of mat forming modules arranged in an in-line orientation comprising: fiberizing molten mineral material in each module; directing said fibers toward a forming chamber and cooling said fibers; collecting said fibers on a foraminous collecting conveyer located in the forming chamber of each of said modules by drawing air through the foraminous conveyer leaving the fibers deposited on the surface of the conveyer to form a mat; conveying said mat in the direction of said in-line orientation from each of said forming chambers to mat delivery stations which are spaced apart in said in-line orientation; collecting said mats sequentially and in a superposed relationship on a transfer conveyer means located adjacent said delivery stations to form a primary product, the improvement comprising using less than all of the modules to produce the primary product and on at least one of the remaining modules removing the mat from the downstream end of the collecting conveyer, elevating said mat to the vicinity of the fiberizing level, cutting said mat into desired lengths, and accumulating said lengths.

A preferred embodiment of the present invention uses one or more rollers to remove the mat from the collecting conveyer and to direct the mat between a pair of heated sear rolls having projections on the roller surfaces forming pattern, e.g. a diamond shaped pattern. The sear rolls at least partially cure the binder contained in the mat, including completely curing and fixing the thickness if desired, giving the mat more strength prior to its being elevated to the fiberizing level by suitable means such as a suction conveyer. Once on the fiberizing level, the mat is pulled by a pair of pull rolls under a set of slitting knives or rollers to edge trim the mat and/or to slit the mat into strips of desired widths. Next, the mat or strips are cut into desired lengths by an appropriate cutting device, wound into a roll, and packaged.

The present invention utilizes existing free time of the fiberizing operators to monitor the slitting, pulling, cutting, and accumulating equipment, and also to remove and package the accumulated mat. In addition to permitting all the modules of the system to continue to operate regardless of the requirements of the primary product, the present invention allows the system to manufacture two or more significantly different products at the same time without requiring additional manpower. The versatility provided by the present invention results in substantial cost savings and advantages in production scheduling.

While the primary products produced by the system are usually limited to relatively thick blankets and products derived therefrom, the additional secondary, relatively thin, mat products produced by the present invention are useful as gas and liquid filtration media, aircraft insulation, etc.

DETAILED DESCRIPTION AND PREFERRED EMBODIMENTS

The system for the manufacture of relatively thick fiber glass blankets disclosed in Ser. No. 236,372 discloses a five module machine, but it is understood that this system can contain a greater or small number of modules depending upon product requirements. Since in this system all of the modules are essentially identical the embodiments used to illustrate the present invention show only two modules for simplicity of illustration, but it is to be understood that the present invention is useful on as few as one and as many as all of the modules in this system.

FIG. 2 is an enlarged side elevational view of a portion of the system shown in FIG. 1 and better illustrates the present invention.

FIG. 3 is a front elevational view, as seen from lines 3—3 in FIG. 2, of the sear rolls.

FIG. 5 is a plan view of that portion of the present invention located on the fiberizing level.

FIG. 6 is a partial view of the system showing an alternative embodiment useful for making a composite product using the improvement of the present invention.

Figure 1:
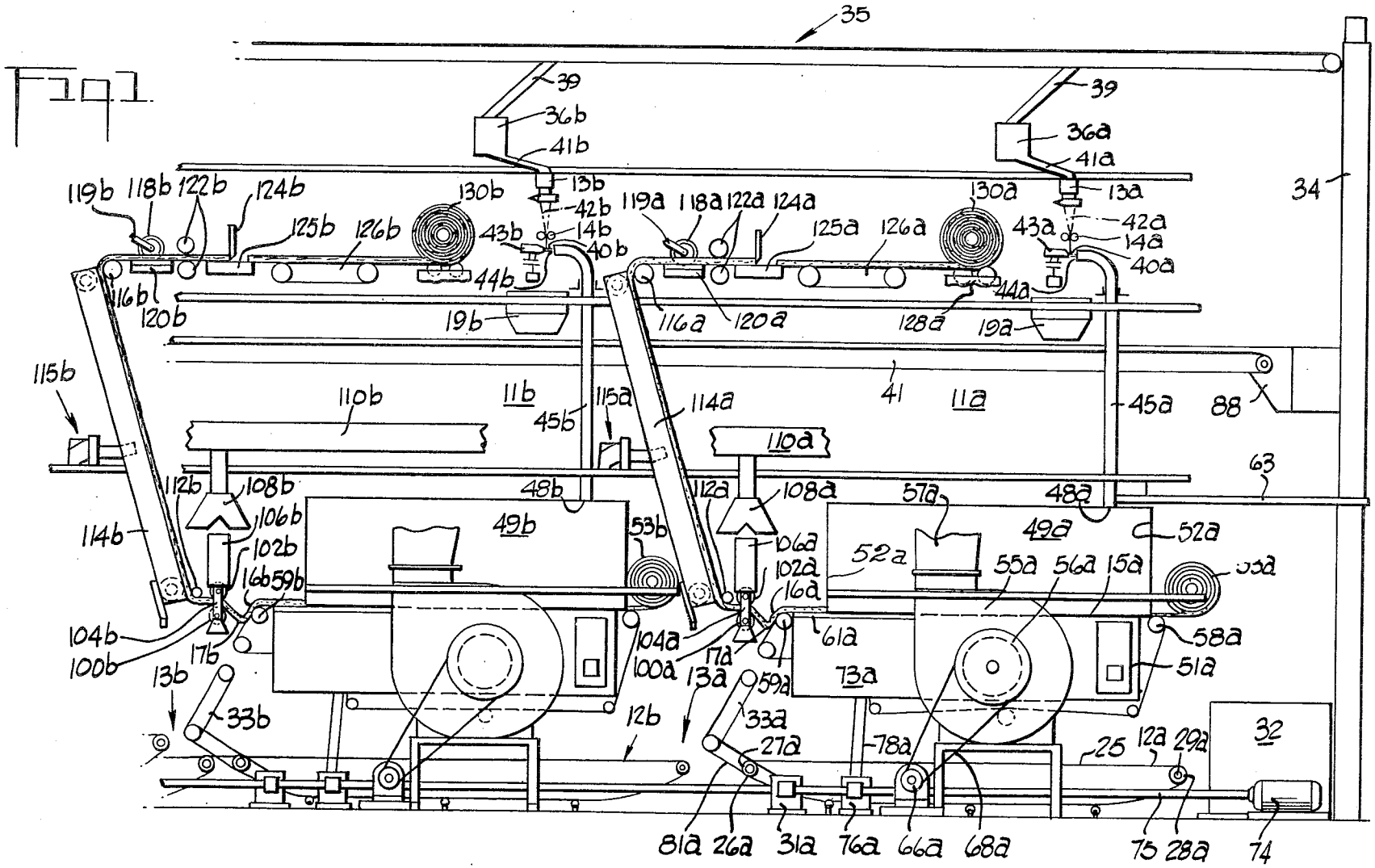
FIG. 1 is an elevational side view of two modules in a pot and marble system of the type described above equipped with the improvements of the present invention. In this figure many of the structural support details have been eliminated to facilitate illustration of the invention.

FIG. 1 represents two modules, preferrably located on one end, of an in-line system containing at least three mat forming modules 11 and preferrably four or more modules arranged in tandem and in convenient mat transfer relationship to a transfer conveyer 12 upon which several mats issuing from modules 11 can be superposed. The modules and their elements will be designated by lower case letter suffixes where appropriate, with two modules considered and identified from right to left in FIG. 1, keeping in mind that additional modules could be located adjacent either end of these two modules in a typical system. Each module contains a fiberizing means which can be any conventional fiberizing means such as a rotary spinner with or without additional attenuation means, flame attenuation apparatus, spinning rollers such as those disclosed in U.S. Pat. Nos. 2,520,168 and 3,045,279, etc. In the embodiments illustrated herein the conventional pot and marble flame attenuation fiberzation technique is utilized.

Each module is made up of a fiber forming means 13 from which molten mineral fibers are exuded and drawn by pull rolls 14. In the preferred embodiment, the fibers are derived by melting glass marbles 13 to which they are fed at a rate to maintain a desired head of marbles and molten glass within the pots. It is to be understood that fiberizable minerals other than glass can be employed and the molten material can be supplied to the fiberizing means from other sources, such as flow channels from a fore-hearth of a furnace in which batch materials are melted and refined, all of which are conventional fiberizing techniques. In the operation of the conventional pot and marble system glass marbles, or other appropriate shapes, are delivered to the pots 13 via elevator 34, conveyer 35, chutes 39, hoppers 36, and chutes 41. The marbles are melted in pots 13 and primary fibers 42 are exuded through holes located in the bottom of the pots 13. These primary fibers, exuded in a curtain pattern, are drawn by pull rolls 14 and extended across the face of attenuation burners 43 which direct high temperature effluent gases at a high velocity toward an open mouth 44 of duct 45. A plurality of pots, pulls rolls, and attenuation burners are aligned across the width of the module to produce a uniform flow of fibers corresponding to the width of a collecting conveyer 15 and to the desired thickness of the product to be collected on conveyer 15. A guide bar 40 is located below the pull rolls 14 for guiding the primary fibers 42 in an evenly spaced manner to the hot gases. Upon reaching the hot gas stream from the burners 43 the primary fibers 42 are resoftened and are attenuated horizonally into small diameter, short, fibers entrained in a gas stream. Attenuation occurs in the initial portion of travel of the effluent gases beyond the cantilevered primary filament ends, and the fibers are solidified by relatively cool ambient air inspirated into the gas stream by the high velocity flow from burners 43 within a fraction of an inch of the primary filament ends.

The attenuated fibers, the entraining burner effluent, and the inspirated ambient air are delivered through the mouth 44 of duct 45. The mount 44 is sized to control the amount of air inspirated so as to minimize turbulence in the entrained fiber stream.

An entrained fiber stream flow is formed from a typical grouping of 12 or 16 burners 43 (6 or 8 pots 13) across a 96 inch duct 45. Laminular flow is retained while turning the entrained fiber stream from horizontal to vertical flow. A typical inner-radius of the duct 45 is between about 18 to 24 inches. Any back eddy effect at duct exit 48 can be minimized by sizing the straight vertical section of the duct 45 to a length of at least 6 times the inner-radius of the curve.

The gas entrained fiber is discharged from tube 45 into a forming chamber 49 above the fiber collecting conveyer 15 and an underlying suction box 51. Binder can be mixed into the stream as a liquid spray from conventionally placed binder applicators (not shown) adjacent duct 48. To maximize exposure of the fiber to cooling ambient air and to enhance mixing of the binder with the fibers the exit 48 of the duct 45 is located a substantial distance above the collection conveyer 15. Ambient air flow in the chamber 49 is confined to that generally paralleling the hot gases, i.e. it enters the chamber 49 adjacent the opening 48. A broad area is provided over the collecting conveyer and a low pressure differential is maintained across the conveyer to permit the withdrawal of air in the form of a low velocity, high volume, flow, thereby enhancing the cooling of the fiber without subjecting it to excessive turbulence or impact.

Advantageously, the lower lips of upstream and downstream walls 52 of the forming chamber 49 are arranged in close proximity to the conveyer 15 and can be provided with seals (not shown) at the apertures through which the continuous conveyer is passed, to prevent ingress of air at the level of the conveyer. Air is removed from the system through conveyer 15 by one or more fans 55 connected through ports 56 in the walls of suction box 51 to a suitable exhaust stack 57.

A layer of foraminous laminating material can be withdrawn from roll 53 and laid down on the collecting conveyer 15 prior to the collection of the fiber thereon so as to form a laminated product. Typical foraminous laminating materials would include scrim of glass fiber or other fibrous materials, thin glass fiber mats having a density significantly different than the density of the fibrous mat to be collected in the forming chamber, and other perforated flexible materials such as flexible perforated polymer sheet. This step is optional and is used only in the manufacture of selected products.

A chain form of conveyer 15 has been found effective. The upper flight is passed over rollers 58 and 59 and is supported in sliding relationship on a grill 61 located above suction box 51. A mat 16 of intertangled fiber is formed on conveyer 15 in the forming chamber 49, and in the conventional process is removed from the conveyer 15 and transferred to the transfer conveyer 12 by an intermediate conveyer 33 or other suitable means, such one or more rollers or other conventional mat conveying means. After the blanket 16 has been removed from the conveyer 15 the conveyer 15 is passed through a suitable cleaning apparatus 73 (not shown) to remove adhering fiber and binder which may have been carried over from the blanket 16. The conveyer 15 is then returned to roller 58 by a pass beneath suction box 51.

In the normal operation of the prior art system described above the speed of conveyer 15 is matched to the speed of conveyers 33 and 12 so that the speeds of the various conveyers do not diverge or converge and thus subject blanket 16 to stress as the mat is passed from the conveyer 15 to the conveyer 33 and onto the transfer conveyer 12, or between sections of the transfer conveyer 12. A main drive motor 74 of the variable speed type drives a line shaft 75 to take-off stations for the several conveyers, which comprise variable speeds drives 76 and belt or chain means 78 for the conveyers 15 and variable speed drives 31 and belt or chain means 81 for the sections of conveyer 12. Where appropriate, for reverse operation of sections of the conveyer 12, drives 31 can incorporate selectively operable reversible means.

In the prior art systems, such as the one described above, a thick blanket having very uniform properties through its thickness can be produced by superposing a plurality of fiberglas mats, one on top of the other, on transfer conveyer 12, each individual mat having been made in a separate module along a in-line system containing 4, 5, or more modules. The thick, lightweight, fiberglas blankets comprising a plurality of individual mats is then conveyed into further conventional processing means (not shown) for bonding the individual mats together, optional shaping and/or densification, trimming to shape, and packaging.

When the primary product desired to be manufactured on these prior art systems is of a thickness or density that requires operation of all of the modules in the line, the systems operate very efficiently. However, many of the products desired to be manufactured using these systems require less than operation of all of the modules. When this occurred in the prior art systems, it was necessary to either shut down the modules not required by the primary product, or to reverse the directions of travel of the sections of the transfer conveyer 12 under these modules and to invest in additional capital expenditure for building space and equipment needed to process the mat or mats manufactured by the unneeded modules and delivered to the end of the line opposite the end delivering the primary product. When the latter option was employed additional personnel were required to process the secondary product because the distance between the fiberizing levels (about 30 or 40 vertical feet and as much as 100 or more horizontal feet) was to great to allow the fiberizing operators to process the secondary product.

The present invention which overcomes the above described problems, and which greatly improves the efficiency and versatility of the above described systems, comprises means for removing the mat 16 from the downstream end of conveyer 15, means for elevating the mat 16 to the fiberizing level, means for cutting the mat 16 into desired lengths, and means accumulating the desired lengths into a form suitable for packaging.

The present invention is thus shown in FIG. 2 and its relationship to the complete module is best shown in FIG. 1. Referring to FIG. 2, the mat 16 is removed from conveyer 15 by one or a combination of several means. It is possible to remove mat 16 from conveyer 15 using a single roller such as 99 in combination with a suction conveyer 114 which gently grips the mat by suction, created by fan 115 connected to a suction box under the conveyer surface 216 via inlet 208, and elevates the mat. It is preferred to use roller 99 located in such a manner that the mat 16 is peeled back in a generally opposite direction from the direction of travel of conveyer 15 to reduce tearing of the mat 16 due to any adhesion of the mat 16 to conveyer 15.

The top surface of the mat just removed from the conveyer 15 should preferably form an acute angle with the top surface of the mat still on the conveyer 15, most preferably a small acute angle to avoid tearing the mat, particularly if the mat has a very low tear strength. When the mat 16 contains a thermosetting binder, it is frequently desired to at least partially cure and even to fully cure the binder prior to elevating the mat to the fiberizing level. This can be accomplished by a passing mat 16 through the nip of a set of heated searing rolls 100 and 102 mounted on supports 104 in such a manner that the nip dimension can be adjusted to accommodate different thicknesses of mat or to apply different amounts of compression to the mat. The manner of mounting opposed rolls for readily adjusting the nip dimension is well known in the art and thus is not shown in detail here. While the surfaces of the sear rolls 100 and 102 can be smooth, it is preferred, particularly when the fibers in the mat are of the very small diameter type, that the surface of at least one of the sear rolls have a raised pattern, such as a diamond shaped pattern as shown on roll 100 in FIG. 3. Preferably both of the rolls should have a raised pattern. Any pattern is suitable and an inexpensive manner of obtaining the diamond pattern shown in FIG. 3 is to wrap a strip of expanded metal around the roll and weld, or attach in any other suitable manner, the expanded metal to the rolls at sufficient points to prevent its warping when the roll is heated.

The rolls 100 and 102 can be heated by line type gas burners, or any other suitable heating means to an appropriate temperature to provide the desired degree of curing of any binder contained in mat 16. When the sear rolls are used, they should be driven at about the same surface speed as conveyer 15. Any fumes or vapors evolved from the curing of the binder can be collected by hood 108 communicating with an exhaust duct 110 which is maintained at a slightly negative pressure by connection to a suitable fan or other suction source. The sear rolls can be replaced or supplemented by heaters, (not shown) e.g. infrared lamps or a conventional curing oven, located adjacent the mat on the suction conveyer.

Figure 4:
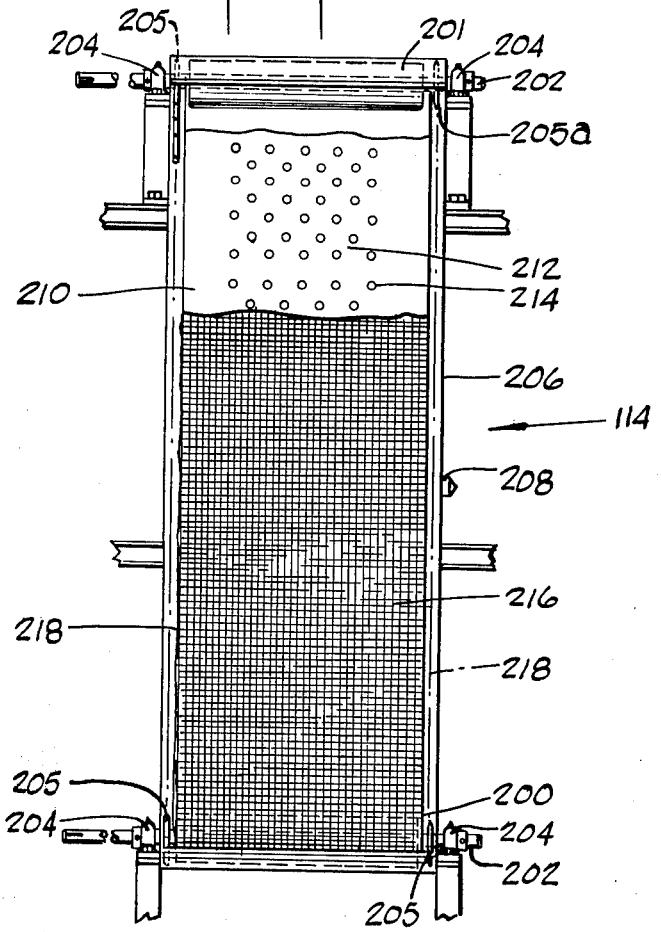
FIG. 4 is a front elevational view, partly broken away, as seen from lines 4—4 in FIG. 2 and illustrates the suction conveyer used to elevate the mat.

Roller 112 insures that the mat will be properly guided onto the suction conveyer 114 for elevation to the fiberizing level. Suction conveyer 114 is shown in more detail in FIG. 4 and comprises a suction chamber 206 communicating with a suction fan 115 via inlet 208. The working surface of the conveyer 114 can be any foraminous material, but preferably is a visual cap Cambridge type belt, chain driven, mesh fabric mounted on a head pulley 201 and a tail pulley 200. Chains 218 are located at the sides of the belt 216 and mesh with sprockets 205 mounted at each end of the tail and head pulleys on drive shafts 202 which are in turn mounted in pillow block bearings 202. One of the drive shafts 204 can be driven by a variable speed drive or by a suitable connection to the drive of conveyer 15 to synchronize the surface speed to that of conveyer 15. The suction chamber 206 of the suction conveyer 114 is separated from the foraminous conveyer belt 216 by cover plate 210 over which the belt 216 slides. A central portion 212 along the length of cover plate 210 contains numerous small openings 214 for the purpose of allowing ambient air to pass through the cover plate and into the suction chamber which causes the mat 16 to be held against the conveyer surface 216 and thus be elevated without sliding or falling along the steep vertical pitch of the elevating conveyer 114.

While it is preferred to elevate the mat 16 to the fiberizing level for further processing because that level makes the most efficient use of the fiberizing operators' spare time, other levels in the vicinity of, i.e. in reasonably close proximity to, the fiberizing level could be used. For example, the fiberizing operator could ascend or descend as much as 10 or 20 feet to process the secondary product, but his efficiency and performance, particularly in the area of his primary responsibility fiberization would suffer.

Referring back to FIGS. 1 and 2, the mat 16 having been elevated to the fiberizing level by conveyer 114 is removed from this conveyer by passing over roll 116. If it is desired to edge trim or to slice the mat into strips narrower than the width of the mat this can be done by passing the mat 16 between spaced apart disc cutters 118 rotating on supports 119 (also see FIG. 5). The cutters 118 have a sharp edge, much like a pizza cutter, and bear against a lower anvil 120 to make a clean cut of the advancing mat 16. Any conventional fiber glass mat trimming and cutting device can be used for this purpose.

Since the mat 16 is being produced continuously, it is necessary to cut the mat into suitable lengths for accumulating. This is accomplished by using a conventional cutter 124 operating against anvil 125. Any suitable fiber glass mat cutting device can be used and thus this cutter is not shown in detail here. The mat 16 is conveyed to an accumulator by a conveyer 126, or any other suitable conveying means, and optionally a roller 127. The accumulator can be a winder 128 for winding the lengths of mat into compact rolls 130. It is not necessary to wind the mat into rolls. The fiberizing operator could remove cut strips and accumulate the strips into stacks for packaging or transfer to other areas of the plant.

When accumulating the fiber glass mat into rolls 130 any suitable winder can be used. After winding of the roll, the fiberizing operator can remove the roll from the winder, reset the winder for making the next roll, and package the roll, if desired, for transfer to a storage area by any suitable means, such as a conveyer, a chute, or a freight type elevator.

Although not essential to the present invention, it is preferred to place one or more sets of mat pulling or pushing rolls 122 on the fiberizing level. These are conventional pull rolls having an adjustable nip dimension between the rolls for purposes of slightly gripping the mat 16 and pulling and/or pushing the mat along the processing line on the fiberizing level to enhance an even flow of the mat through the trimming and cutting devices.

As mentioned earlier, each module in a pot and marble operation requires a fiberizing operator who must remain in the general area of the formation of the primary fibers 42 for frequent observation thereof and to correct any malfunctions in the fiberizing operation. This task normally requires less than half of the fiberizing operators time. Thus, the fiberizing operator has sufficient slack time from his primary duties to observe the equipment of the present invention on the fiberizing level and to either accumulate, or to remove accumulated product from the end of the line, package the product where required, and place the product on suitable conveying means for conveyance to storage or to other portions of the manufacturing plant. Normally, if the product is a finished product any binder contained therein would be fully cured, but if the product is merely an intermediate product for use in additional processing equipment elsewhere any binder contained therein may be only partially cured or not cured at all. Thus the present invention, without requiring any additional manpower and without requiring any additional building space, allows a very costly manufacturing system to operate at maximum efficiency regardless of the requirements of the primary product, and further provides the system with additional product versatility.

In addition to having different thicknesses or densities than the primary product, the secondary products can also contain fibers differeing in composition and in diameter by feeding different glass compositions to the fiberizing devices of the unneeded modules and by varying the numbers of fiber forming devices or the size of the orifices in the fiber forming devices in each module. Thus, for example, whereas four modules in a six module system may be cooperating in the manner of the prior art to produce a thick blanket of fiberglas thermal insulation having relatively course fibers of a composition A suitable for that product, one of the unneeded modules might be producing rolls of a thin mat of smaller diameter fibers of composition B suitable as gas filtration media and the other of the unneeded modules might be producing rolls of a fiber glass scrim backed thin mat containing glass fibers of composition A, B, or C having diameters similar to or different than either A or B.

When it is desired to make a composite product, i.e. a product having two or more layers with each layer having different properties, and when two of the modules are not required for the primary product the alternative embodiment shown in FIG. 6 can be used. In this embodiment a mat 16*a* is formed in the a module of fibers having the properties desired in one of the layers. Mat 16*a* is removed from the collection conveyer 15*a* by sear rolls 100*a* and 102*a* and conveyed by conveyer 101 to a second adjacent module, *b* module, where a second layer of fibers is formed thereon. The fibers forming the second layer will have the properties desired for that layer. The two layers emitted from module *b* would then be processed according to the improvement of the present invention described earlier.

In the alternative embodiment shown in FIG. 6 the sear rolls 100*a* and 102*a* can be operated cold, in which case they would function only as pull rolls, or they can be heated to partially or completely cure the binder in mat 16*a*. These rolls can also be used to compress and fix the thickness of the mat 16*a*. For example, it may be desirable to produce a density in mat 16*a* that will differ from the density that will be later fixed in the second layer formed in module *b* by the sear rolls located at the end of module *b*.

Figure 7:
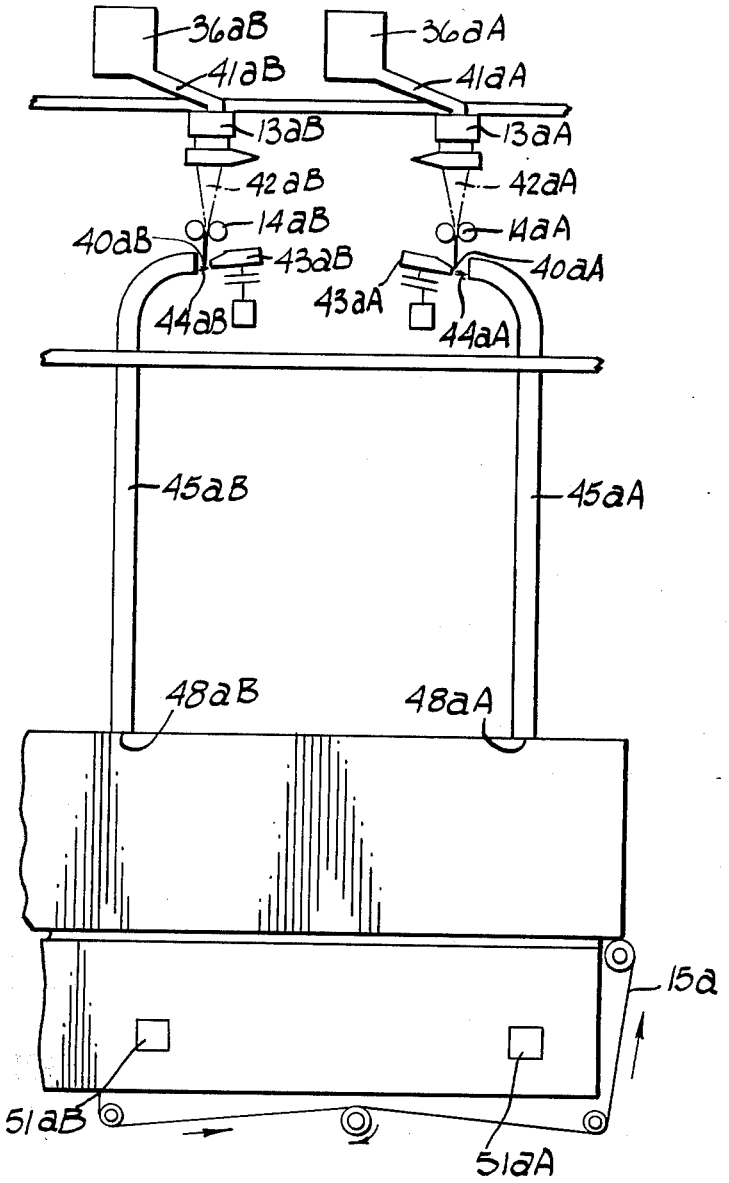
FIG. 7 is a partial view of one module of the system showing another alternative embodiment useful for making a composite product using the improvement of the present invention.

FIG. 7 shows another alternative embodiment wherein a composite two layered product can be made in a single module. The apparatus used to direct two sequential fiber flows into the same collection chamber of a single module is described in detail in U.S. Pat. application Ser. No. 236,372. By varying the type of fibers formed for each of the two flows, and the relative forming rates, the properties and thickness of each of the layers can be controlled to produce the desired product. The two superposed layers emitted from the collection chamber of the embodiment can then be processed according to the improvement of the present invention described earlier.

In describing the invention certain embodiments have been used to illustrate the invention and the practice thereof. However, the invention is not limited to these specific embodiments as other embodiments and modifications within the spirit of the invention will readily occur to those skilled in the art on reading this specification. The invention is thus not intended to be limited to the specific embodiments disclosed, but instead is to be limited only by the claims appended hereto.

What is claimed is:

1. In a production line for the production of a thick mineral blanket comprised of a plurality of superposed mineral fiber mats comprising:

a. a plurality of mat forming modules arranged in an in-line orientation, along the production line each of said modules comprising:
   i. a level having fiberizing means thereon,
   ii. a mat forming chamber,
   iii. a mat delivery station,
   iv. a foraminous fiber collecting conveyor located in said forming chamber to collect fiber in mat form and to convey said mat from said forming chamber to said mat delivery station,
   v. a section box in communication with said forming chamber through said fiber collecting conveyor, b. a transfer conveyor means located below said fiberizing level and arranged to travel adjacent to the plurality of said mat delivery stations spaced along said in-line orientation for receiving mats sequentially from the individual delivery station spaced along said transfer conveyor means to form a thick blanket of superposed mats, the improvement comprising: at least one of said modules comprising, c. means located adjacent the downstream end of said collecting conveyor for removing said mat from said collecting conveyor, d. means for elevating said mat to the vicinity of the fiberizing level, e. means for cutting said mat into desired lengths, and f. means for accumulating said cut lengths, whereby a mat from at least one module is individually elevated to the vicinity of the fiberizing level and accumulated while the mats from the remaining modules are directed onto said transfer conveyor means to form a different product.

2. A production line as defined in claim 1 wherein means (*c*) comprises a roller located in such a manner that the top surface of the mat passing over said roller after leaving said fiber collecting conveyer forms an acute angle with the top surface of the mat which has not yet been removed from said fiber collecting conveyer.

3. A production line as defined in claim 1 wherein said improvement further comprises:

g. means for heating said mat to a temperature sufficient to at least partially cure any binder contained therein.

4. A production line as defined in claim 3 wherein means (*g*) comprises a pair of sear rolls and at least one of said sear rolls has a raised pattern on its outer surface.

5. A product line as defined in claim 1 wherein means (d) comprises a suction conveyer having a guide means located adjacent the tail end thereof for positioning the mat thereon in the proper location and in the proper alignment.

6. A production line as defined in claim 1 wherein said improvement further comprises:

h. means for edge trimming said mat.

7. A production line as defined in claim 6 wherein means (*h*) also includes means for slicing said mat into two or more strips.

8. A production line as defined in claim 1 wherein the improvement further comprises:

i. at least one pair of driven pull rolls located in the vicinity of said fiberizing level to enhance the removal of said mat from said elevating means and to enhance the flow of said mat through said cutting means and into said accumulating means.

9. A production line as defined in claim 8 wherein the improvement further comprises:

j. conveying means located between said cutting means and said accumulating means for conveying said mat to said accumulating means.

10. A production line as defined in claim 1 wherein said means (*f*) comprises winding means for winding said mat into a roll.

11. A production line as defined in claim 1 wherein the improvement further comprises:

k. means located adjacent the upstream end of said fiber collecting conveyer for feeding a foraminous laminating backing material onto said fiber collecting conveyer.

12. A production line as defined in claim 11 wherein said backing material is conveyed from the downstream end of a collection conveyer located in an adjacent module.

13. A production line as defined in claim 1 wherein at least one of said modules comprises:

vi. means for forming a composite mat comprising at least two layers.

14. In a method for the production of thick mineral fiber blanket products by means of superposing a plurality of thin mats sequentially in a production line having a plurality of mat forming modules arranged in an in-line orientation along said production line comprising:

a. fiberizing molten material in each module on a first level;

b. directing said fibers toward a forming chamber and cooling said fibers;

c. collecting said fibers on a foraminous collecting conveyor located in the forming chamber of each of said modules by drawing air through the foraminous conveyor leaving the fibers deposited on the surface of the conveyor to form a mat on a second level located a substantial distance below said first level;

d. conveying said mat in the direction of said in-line orientation from each of said forming chambers to mat delivery stations which are spaced apart in said in-line orientation;

e. collecting said mat sequentially and in a superposed relationship upon a transfer conveyor means located below said fiberizing level and adjacent said delivery stations to form a thick blanket primary product, the improvement comprising;

f. using less than all of the modules to produce the primary product, and g. on at least one of the remaining modules;

i. removing the mat from the downstream end of the collecting conveyor, ii. elevating said mat to the vicinity of the fiberizing level, iii. cutting said mat into desired lengths, and iv. accumulating said lengths to produce one or more secondary products simultaneously with the production of the primary product.

15. A method as defined in claim 14 wherein the improvement further comprises:

v. feeding a foraminous laminating material to the upsream end of said collecting conveyer prior to depositing the fibers, thereby forming a fibrous mat adjacent said foraminous laminating material.

16. A method as defined in claim 14 wherein the improvement further comprises:

vi. applying a thermosetting binder to said fibers prior to step (c) and vii. heating said mat after its removal from said collecting conveyer and before it is elevated to the vicinity of said fiberizing level to at least partially cure said thermosetting binder.

17. A method as defined in claim 14 wherein the improvement further comprises controlling the fiberizing in step (*a*) such that the fibers produced in the modules operating on the primary product have a diameter different than the fibers produced in the at least one of the remaining modules.

18. A method as defined in claim 14 wherein the molten mineral material fiberized in step (*a*) in the modules producing the primary product is of a composition different than that of the molten mineral material being fiberized in the at least one remaining module.

19. A method as defined in claim 14 wherein two of the modules not required in the manufacture of the primary product are used to produce a composite secondary product having at least two distinct layers bonded together, one of said layers being formed in the first of said two modules and then being transferred to the second of said two modules where the second layer is formed over the first layer.

20. A method as defined in claim 14 wherein said mat produced in said at least one of said remaining modules is comprised of at least two distinct layers.

* * * * *